US006851369B2

(12) United States Patent
Hummel et al.

(10) Patent No.: US 6,851,369 B2
(45) Date of Patent: Feb. 8, 2005

(54) ACCESS CONTROL FOR ELECTRONIC BLASTING MACHINES

(75) Inventors: Dirk Hummel, Hennef (DE); Olaf Cramer, Essen (DE)

(73) Assignee: Orica Explosives Technology PTY Ltd., Melbourne (AU)

( * ) Notice: Subject to any disclaimer, the term of this patent is extended or adjusted under 35 U.S.C. 154(b) by 0 days.

(21) Appl. No.: 10/652,262

(22) Filed: Aug. 29, 2003

(65) Prior Publication Data

US 2005/0000382 A1 Jan. 6, 2005

Related U.S. Application Data

(60) Provisional application No. 60/406,957, filed on Aug. 30, 2002.

(51) Int. Cl.[7] ..... F42B 3/18

(52) U.S. Cl. ..... 102/200; 102/202.1; 102/214; 102/215; 102/217; 102/221; 102/275.11

(58) Field of Search ..... 102/200, 214, 102/215, 217, 221, 275.11, 202.1, 293

(56) References Cited

U.S. PATENT DOCUMENTS

| | | | | | |
|---|---|---|---|---|---|
| 4,665,396 | A | * | 5/1987 | Dieleman | 713/159 |
| 4,674,047 | A | | 6/1987 | Tyler et al. | 364/423 |
| 4,869,171 | A | * | 9/1989 | Abouav | 102/215 |
| 5,014,622 | A | * | 5/1991 | Jullian | 102/312 |
| 5,090,321 | A | * | 2/1992 | Abouav | 102/200 |
| 5,295,438 | A | | 3/1994 | Hill et al. | 102/217 |
| 5,520,114 | A | | 5/1996 | Guimard et al. | 102/215 |
| 5,894,103 | A | * | 4/1999 | Shann | 102/215 |
| 6,082,264 | A | * | 7/2000 | Meyer et al. | 102/202.9 |
| 6,253,679 | B1 | * | 7/2001 | Woodall et al. | 102/221 |
| 6,422,145 | B1 | * | 7/2002 | Gavrilovic et al. | 102/200 |
| 6,546,873 | B1 | * | 4/2003 | Andrejkovics et al. | 102/200 |

FOREIGN PATENT DOCUMENTS

| | | |
|---|---|---|
| EP | 0 897 098 | 2/1999 |
| EP | 1 125 094 | 6/2002 |
| GB | 2093286 | 8/1982 |
| WO | WO 99/24776 | 5/1999 |
| WO | WO 00/04337 | 1/2000 |
| WO | WO 00/09967 | 2/2000 |
| WO | WO 00/26607 | 5/2000 |
| WO | WO 00/63636 | 10/2000 |

* cited by examiner

*Primary Examiner*—Teri P. Luu
*Assistant Examiner*—Bret Hayes
(74) *Attorney, Agent, or Firm*—Fulbright & Jaworski L.L.P.

(57) ABSTRACT

Blasting apparatuses and methods control actuation of a plurality of detonators, and involve the use of one or more authorization keys each associated with a blasting machine. The authorization key(s) are transferable from the blasting machine(s) to a central command station, each authorization key storing a data package comprising a randomly generated access code generated by its corresponding blasting machine. Transfer of the one or more authorization keys to a central command station allows the data packages (and associated randomly generated access codes) to be transmitted by the central command station for receipt by the blasting machine(s).

35 Claims, 5 Drawing Sheets

ACCESS CONTROL FOR ELECTRONIC BLASTING MACHINES

CROSS REFERENCE TO RELATED APPLICATION

This application claims the priority right of our co-pending provisional application Ser. No. 60/406,957 filed Aug. 30, 2002.

FIELD OF THE INVENTION

The present invention relates to the field of remote actuation of detonators. More specifically, the invention relates to systems and methods for improving the safety and/or preventing unauthorized usage of blasting systems involving detonators.

BACKGROUND TO THE INVENTION

Typical blasting systems can involve one or more blasting machines, each in direct communication with a plurality of detonators. Command signals can be transmitted to the blasting machine(s) by a central command station that is located remote from the vicinity of the blast. Such command signals may include signals to ARM, FIRE or DISARM the detonators.

The communication between the central command station and the blasting machine typically occurs via radio-communication, but may also involve direct electric or non-electric connection. Likewise, the communication between the blasting machine and the detonators may also involve radiocommunication, but more typically involves direct connection, for example, via electrical wiring. In any event, command signals transmitted by the central command station are received by the one or more blasting machines, and subsequently relayed to the detonators.

In any blasting system, safety considerations are paramount. Several systems and methods have been previously developed to help improve the safety of blasting systems, with the intention of preventing unintentional detonator actuation, premature blasting prior to proper evacuation of the blast area, or unauthorized use of the blasting system.

In one example, U.S. Pat. No. 4,674,047 issued Jun. 16, 1987, discloses a detonation system in which a number of electronic detonators can each be programmed with a unique identification number and delay time by means of a user-operable firing console. A command from the firing console includes a unit identification code which is used to address or designate a specific integrated delay detonator. The system may further include additional security code measures to help prevent unauthorized use.

In another example, U.S. Pat. No. 5,298,438 issued Mar. 22, 1994 discloses an apparatus for timing and initiating a multi-shot blast involving a transportable programming tool for individually programming a plurality of electronic detonator arrangements with delay time data relative to a common initiate command signal. The detonators are all connected to a control unit via a single cable, and an initiation signal triggers the detonator delay units to start timing our their respective programmed delay times. A similar arrangement is disclosed by U.S. Pat. No. 5,894,103 issued Apr. 13, 1999. However, the system provides for multiple detonator circuits in connection with a control unit, wherein each detonator circuit can be separately programmed with a delay time. Moreover, each detonator circuit is assigned a specific identification code for individual communication with the control unit. The system further includes a portable device for programming the delay times into the control unit.

U.S. Pat. No. 5,520,114 issued May 28, 1996, discloses an apparatus and method for firing detonators involving a programming unit for programming a series of ignition modules with delay times. The firing console can subsequently simultaneously interrogate the ignition modules, which send back the requested information to program the firing console with the delay times. The firing console and the programming unit may be fitted with encoding means designed to limit their access to authorized users, and with means for internal mutual recognition before the transfer of delay times from the programming unit to the firing console. Further optional safety features require the operator to know recognition codes to access the firing and programming consoles. For example, the firing console can be fitted with a magnetic card for authorizing its use.

In yet another example, International Patent Application PCT/AU98/00929 published Nov. 6, 1998 discloses an electromagnetic induction detonation system involving an automated radio charge (ARCH) module connectable to an electric detonator and a transducer. The system further includes a remote controller for sending instructions to the transducer module from a remote location. Actuation of the detonator requires the transducer module to generate an electromagnetic field which is used to power the ARCH module and provide a detonation current. In one embodiment, the remote controller includes means for the manual entry of instructions by which a user must enter a valid identification number within a predetermined time period in order for the remote controller to establish a radio communication link with the transducer unit. In another embodiment, the remote controller unit includes a processor means for generating a unique identification code word which is continuously transmitted until an acknowledgement signal is received from the transducer unit corresponding to the identification code word. In the absence of receipt of the acknowledgement signal within a predetermined time period the remote controller adopts a 'reset' mode, thereby requiring a user to enter a new valid identification code before communication with the transducer unit is re-established.

In another example, International Patent Application PCT/EP99/08122 published May 11, 2000 discloses a detonation system for detonators which can be initiated by radio signals. The system includes at least one initiation device connected to at least one detonator, and a detonation device that can communicate with the initiation device via radio signals. At least one of the initiation units contains a removable data carrier which can be inserted into the detonation unit. In addition, the detonation device includes a reading device for reading the data on the inserted data carrier. The initiation device and the data support allocated thereto contain identical identification characteristics and information necessary for initiating the connected detonator. The initiation device is activated by removing the data carrier, and can be placed in a receiving state (or a transmitting/receiving state for bi-directional communication). Likewise, the detonation device is placed in a transmitting standby mode or a transmitting and receiving standby mode after inputting the data from the data carrier.

In a final example, International Patent Application PCT/AU00/00351 published Oct. 26, 2000 discloses a method and system for controlling a blasting network for use where spurious command signals may be passed through a blasting controller to the blasting network without the authorization of the authorized user, for example when the controller is connected to the Internet or Intranet. The system includes a firewall whereby the communication link between the controller and the blasting network can be placed in a control mode by a switch. In the control mode, designated unsafe messages are prevented from reaching the blasting network.

The detonation systems of the prior art thus provide various means for improving the safety and security of the blasting process. Nonetheless, no blasting system can provide absolute safety and security, and there remains a need for improved blasting systems configured to reduce the possibility of inappropriate detonator actuation or unauthorized use.

SUMMARY OF THE INVENTION

An object of the present invention, at least in a preferred form, is to provide systems and methods for actuating detonators with improved safety and security.

Another object of the present invention, at least in a preferred form, is to provide a system involving cross-communication between components of a detonation system for the purposes of verification that the system is operated by an authorized user.

Another object of the present invention, at least in a preferred form, is to provide a system involving cross-communication between components of a detonation system for the purposes of verification that the conditions are appropriate for safe firing of the detonators.

In a first aspect of the present invention, there is provides an apparatus for controlling a plurality of detonators comprising:

a central command station adapted to transmit one or more command signals;

one or more blasting machines in signal communication with both the central command station and a group of detonators, each blasting machine including means for generation of a data package comprising a randomly generated access code, means for receiving one or more command signals and one or more data packages transmitted by the central command station, and means for comparing generated and received data packages;

one or more authorization keys adapted for: (a) physical association with one or more blasting machine, (b) direct transfer to and storage of each data package, and (c) physical transfer from the one or more blasting machines to the central command station for delivery of the stored data package(s) to the central command station;

whereby the central command station, after receiving the data package(s) from the authorization key(s) transmits one or more command signals and the data package(s) to the blasting machine(s), whereupon any one blasting machine responds to said one or more command signals only if one of the data packages received from the central command station is the same as the data package originally generated by said any one blasting machine.

Preferably, any one data package further comprises a unique identification code corresponding to the blasting machine that generated said any one data package. Preferably, the central command station transmits the data package(s) and the command signal(s) to the blasting machine(s) simultaneously. Alternatively, the central command station transmits the data package(s) and the command signal(s) to the blasting machine(s) sequentially.

Preferably, the central command station further includes encryption means, and each blasting machine further includes descrambling means, so that the one or more command signals and/or the one or more transmitted data packages are encrypted by the encryption means upon transmission from the central command station, and descrambled by the descrambling means upon receipt by each blasting machine. More preferably, the one or more command signals and/or the one or more data packages are encrypted by 32 bit encryption.

Preferably, in accordance with the apparatus of the present invention, the randomly generated access codes are active for a single blasting event. Preferably, the randomly generated access codes are active within a predetermined time window, outside of which the one or more blasting machines will not respond to the one or more command signals and the one or more data packages transmitted by said central command station. Preferably, the central command station is located remote from the one or more blasting machines and said detonators. More preferably, the one or more blasting machines and the central command station are in radio-signal communication.

Preferably, the one or more detonators are in signal communication with the one or more blasting machines via low energy detonation cord, shock tube, or electrical connection.

In another aspect of the apparatus of the present invention, the one or more authorization keys may preferably comprise a single authorization key transferable between the one or more blasting machines for storing each of the one or more data packages.

Preferably, the command signals include ARM, FIRE, or DISARM signals. More preferably, the FIRE signals are specific for each detonator or each group of detonators, each FIRE signal including a delay component to specify a firing delay for each detonator or each group of detonators thereby determining a firing sequence for the detonators.

In another aspect, the apparatus of the present invention may further comprise:

a master key including a memory for storing detonator firing codes;

wherein each of said detonators includes a built-in firing code, and association of said master key with said central command station permits transfer of stored detonator firing codes to said central command station for transmission to said one or more blasting machines, said one or more blasting machines each including means for relaying said detonator firing codes to said detonators, any one blasting machine relaying said detonator codes and command signals only if one of the data packages received from the central command station is the same as the data package originally generated by said any one blasting machine, each detonator firing only if one of said relayed detonator firing codes relayed from an associated blasting machine is the same as said built-in firing code for said any one detonator.

In another aspect, the present invention provides a method of controlling a plurality of detonators, the method comprising the steps of:

(a) providing a central command station adapted to transmit command signals;

(b) providing one or more blasting machines each in signal communication with a group of detonators and the central command station;

(c) generating a data package in each blasting machine, each data package comprising a randomly generated access code;

(d) providing one or more authorization keys, each authorization key adapted for: (a) physical association with one or more blasting machine, (b) direct transfer to and storage of each data package, and (c) physical transfer from the one or more blasting machines to the central command station for delivery of the stored data package(s) to the central command station;

(e) transferring each authorization key from said one or more blasting machines to said central command station;

(f) inputting each data package from said one or more authorization key to said central command station;

(g) transmitting one or more command signals together with said one or more data packages from said central command station to said one or more blasting machines, any one blasting machine responding to said one or more command signals only if one of the data packages received from the central command station is the same as the data package originally generated by said any one blasting machine.

In accordance with the above-described method of the present invention, preferably any one data package further comprises a unique identification code corresponding to the blasting machine that generated said any one data package. Preferably, in step (g) of the above-described method the central command station transmits the data package(s) and the command signal(s) to the blasting machine(s) simultaneously. Preferably, in step (g) of the above-described method the central command station transmits the data package(s) and the command signal(s) to the blasting machine(s) sequentially. Preferably, the one or more command signals and/or the one or more transmitted data packages are encrypted upon transmission by the central command station, and descrambled upon receipt by each blasting machine. More preferably, in step (g) the one or more command signals and/or the one or more data packages are encrypted by 32 bit encryption. Preferably, the randomly generated access codes are active for a single blasting event. Preferably, the randomly generated access codes are active within a predetermined time window, outside of which the blasting machine will not respond to said one or more command signals and said one or more data packages transmitted by said central command station.

In accordance with another aspect of the methods of the present invention, the central command station is preferably located remote from said one or more blasting machines and said one or more detonators. More preferably, the one or more blasting machines and the central command station are in radio-signal communication.

Preferably, each group of detonators is in signal communication with each blasting machine via low energy detonation cord, shock tube, or electrical connection.

Preferably, in accordance with the methods of the present invention, the one or more authorization keys comprises a single authorization key transferable between the one or more blasting machines and the central command station for storing each of the one or more data packages.

Preferably, the one or more command signals include ARM, FIRE, or DISARM signals. More preferably, the FIRE signals are specific for each detonator or group of detonators, each FIRE signal including a delay component to specify a firing delay for each detonator or group of detonators thereby determining a firing sequence for the detonators.

In another aspect of the present invention, there is provided a method of controlling initiation of a plurality of detonators each having a unique built-in firing code, the method comprising the steps of:

(a) providing a central command station;

(b) providing one or more blasting machines each in signal communication both with a group of detonators and the central command station;

(c) generating a data package in each blasting machine, each data package comprising a randomly generated access code;

(d) providing one ore more authorization keys, each authorization key adapted for: (a) physical association with one or more blasting machine, (b) direct transfer to and storage of each data package, and (c) physical transfer from the one or more blasting machines to the central command station for delivery of the stored data package(s) to the central command station;

(e) transferring each authorization key from said one or more blasting machines to said central command station;

(f) inputting each data package from said one or more authorization keys to said central command station;

(g) providing a master key including a memory for storing detonator firing codes;

(h) transferring the detonator firing codes from the master key to the central command station;

(i) transmitting one or more command signals, the detonator firing codes, and said one or more data packages from said central command station to said one or more blasting machines, any one blasting machine relaying said detonator codes and command signals to the associated detonators only if one of the data packages received from the central command station is the same as the data package originally generated by said any one blasting machine, each detonator firing only if one of said relayed detonator firing codes relayed from an associated blasting machine is the same as said built-in firing code for said any one detonator.

Preferably, in accordance with the above-described method, any one data package may further comprise a unique identification code corresponding to the blasting machine that generated said any one data package. Preferably, in step (i) the central command station transmits the detonator codes, the data package(s) and the command signal(s) to the blasting machine(s) simultaneously. Preferably, in step (i) the central command station transmits the detonator codes, the data package(s) and the command signal(s) to the blasting machine(s) sequentially. Preferably, the master key further stores user identification information for recognition by said central command station. Preferably, the detonator firing codes comprise detonator identification codes and/or detonator delay times.

In accordance with another aspect of the present invention there is provided a system for controlling one or more detonators, the system comprising:

a central command station;

a blasting machine in signal communication with said central command station, said blasting machine in signal communication with one or more detonators, said blasting machine including means for generating and storing a data package comprising an identification number for the blasting machine and a randomly generated digital access code; and an authorization key transferable from said blasting machine to said central command station, said authorization key including a memory for storing said data package;

whereby said authorization key including said data package is transferable from said blasting machine to said central command station, so that said central command station may transmit one or more command signals together with said data package to said blasting machine, and whereby said blasting machine will respond to said command signals only if said generated and received data packages correspond.

In another aspect of the present invention there is provided a method of controlling a system for initiating one or more detonators, the method comprising the steps of:

(a) providing a central command station;

(b) providing a blasting machine in signal communication with the one or more detonators and the central command station;

(c) generating a data package in said blasting machine, said data package comprising an identification number for said blasting machine and a random digital access code;

(d) storing said data package on an authorization key;

(e) transferring said authorization key from said blasting machine to said central command station;

(f) inputting said data package from said authorization key to said central command station;

(g) transmitting one or more command signals together with said data package from said central command station to said blasting machine, said blasting machine responding to said one or more command signals only if said generated and transmitted data packages correspond.

In another aspect of the present invention there is provided a method of controlling initiation of one or more detonators, the method comprising the steps of:

(a) providing a central command station;

(b) providing a blasting machine in signal communication with the one or more detonators and the central command station;

(c) generating a data package in said blasting machine, said data package comprising an identification number for said blasting machine and a random digital access code;

(d) storing said data package on an authorization key;

(e) transferring said authorization key from said blasting machine to said central command station;

(f) inputting said data package from said authorization key to said central command station;

(g) providing a master key including a memory comprising detonator firing codes;

(h) transferring the detonator firing codes from the master key to the central command station;

(i) transmitting the detonator firing codes together with said data package from said central command station to said blasting machine, said blasting machine relaying said detonator firing codes to said one or more detonators only if said generated and received data packages correspond, each detonator firing only if one of said relayed detonator firing codes relayed from the blasting machine corresponds to its built-in firing code.

DEFINITIONS

'Blasting machine'—a device in signal communication with one or more detonators, for arming, disarming, and firing thereof via the receipt and/or relay of signals transmitted from a central command station. A typical blasting machine may be in communication with one or more detonators or groups of detonators via radio-communication or direct physical connection (e.g. low energy detonating cord, shock tube, or electrical connection).

<(Blasting machine/unique) 'identification code'>—any form of code that provides unique identification of a specific blasting machine, and differentiates that blasting machine from other blasting machines in the apparatus or system. Typically, an identification code may be semi-permanently assigned to a blasting machine for a predetermined time period, or for the lifetime of the blasting machine.

'Central command station'—any device that transmits signals via radio-transmission or by direct connection, to one or more blasting machines. The transmitted signals may be encoded, or encrypted. Typically, the central blasting station permits radio communication with multiple blasting machines from a location remote from the blast site.

'Detonator firing code'—includes both identification information and/or delay time information for an individual detonator or a group of detonators.

'Key'—any portable means for storing data.

'Randomly generated access code'—any form of code that is generated at random sufficient to provide a form of identity to the blasting machine and corresponding data package. Such a code may take the form of digital, analog etc. code. Typically, such a code will be in digital format, and be 'active' for only a single or a few blasting events.

DETAILED DESCRIPTION OF THE PREFERRED EMBODIMENTS

The present invention provides significant improvements to the blasting apparatus or system disclosed in international patent application PCT/EP99/08122. The improvements include the addition of several new features, which co-operate together to improve the operative safety and security of the system. International patent application PCT/EP99/08122 pertains to a relatively simple blasting system that includes some useful aspects, including the use of a data carrier to transfer identification information from one or more blasting machines to a central command station. It is the intention of the present invention to utilize the technology disclosed in PCT/EP99/08122, and to incorporate this technology into a system and method for blasting that provides a higher degree of safety and security on multiple levels.

Figure 1:
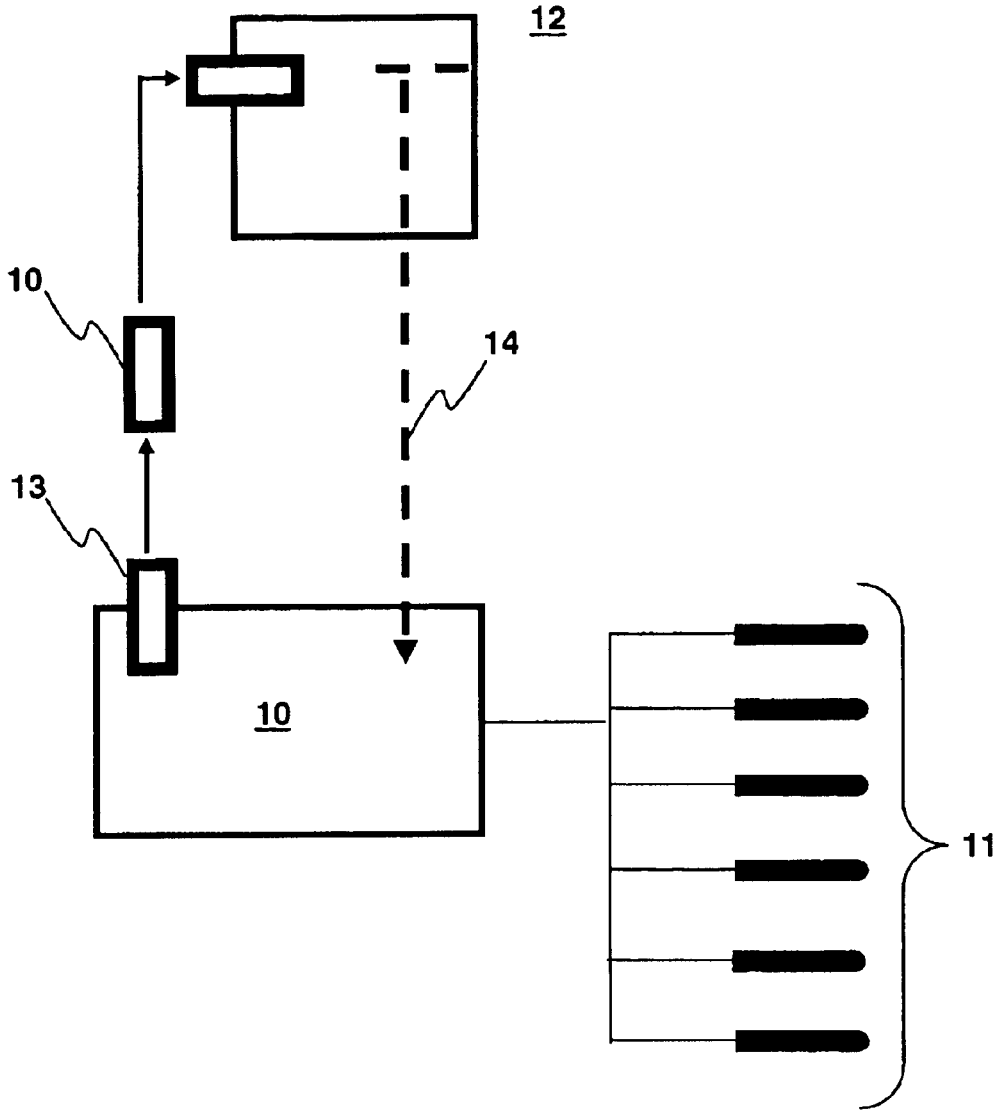
Figure 1 (Prior art)
FIG. 1 schematically illustrates a prior art blasting system involving a central command station, and a blasting machine comprising a removable data carrier.

The prior art apparatus disclosed in PCT/EP99/08122 is illustrated schematically in FIG. 1. The system includes one or more blasting machines 10 (for ease of illustration only one blasting machine is indicated in FIG. 1). Each blasting machine 10 is connected to a plurality of detonators 11, and can transmit a signal to arm, disarm or fire one or more of the detonators as appropriate. The system further includes a central command station 12, which can be located at a spatial distance from the blasting machine(s), whereby at least the central command station can communicate with the blasting machine(s) via radio signals (or other communication means). At least one of the blasting machines includes a removable data carrier (13), which can be removed from the blasting machine and inserted into the central command station. The blasting machine and the data carrier allocated thereto contain identical identification characteristics and information necessary for initiating the connected detonators. Transfer of the data carrier from the blasting machine to the central command station may preferably activate transmit and receive characteristics of the two system components. Once the data carrier is inserted into the central command station the identification characteristics and detonator initiation information can be transferred into the memory of the central command station to subsequently activate communication 14 with the blasting machine.

Figure 2:
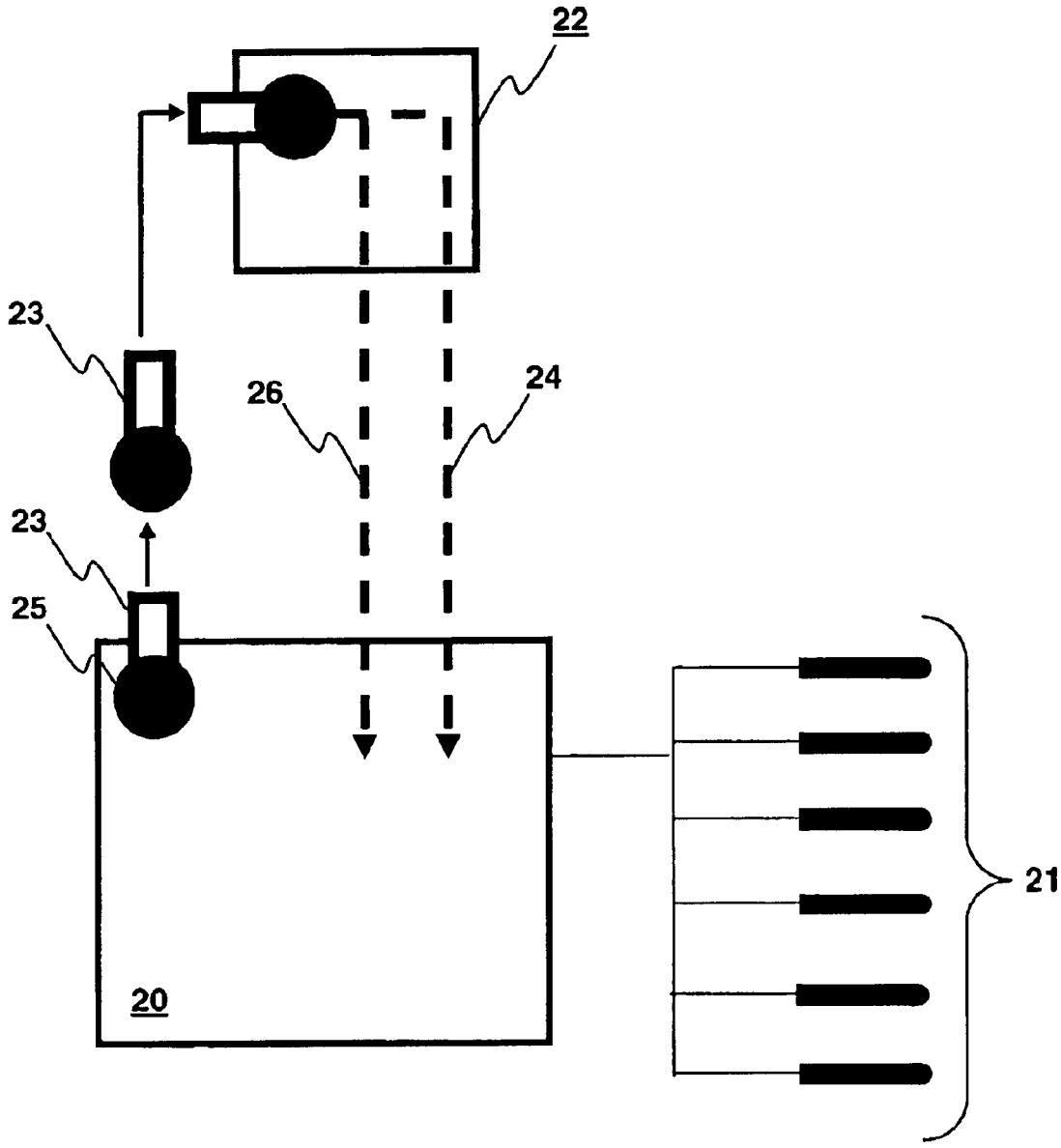
FIG. 2 schematically illustrates an embodiment of the blasting system of the present invention.

The apparatus or system of the present invention is illustrated schematically in FIG. 2. In one aspect, the system differs from that illustrated in FIG. 1 by the inclusion of one or more blasting machines (for ease of illustration, only one blasting machine is illustrated in FIG. 2), wherein each blasting machine can generate and store a randomly generated access code 16 for a specific blasting event. Preferably the randomly generated access code 16 is only useful for a single blasting event within a predetermined time window, such that failure to initiate blasting within the time window requires the blasting machine to generate a new access code.

The randomly generated access code is incorporated into a data package 25. The randomly generated access code can by itself be sufficient to assign a unique identity to the blasting machine in question for one or more blasting events. However, it is most preferable for the data package to further comprise additional identification information specific to the blasting machine, such as for example a unique blasting machine identification code, which can be used for single or multiple blasting events, or preferably can provide a permanent identity to the blasting machine when integrated into an operational blasting system.

In any event, the blasting machine stores the data package and further provides a copy of the data package 25 on an authorization key 23. The authorization key 23 may take any form of data storage device that is readily portable and transferable to a location remote from the blasting machine. Most preferably, the authorization key 23 takes the form of a key to switch the blasting machine 20 on. In this way the key may be inserted into the blasting machine, and the process of switching on the blasting machine instigates the random generation of a new access code, and the recordal of the code on the key (preferably together with the relevant blasting machine identification code). Most preferably, removal of the authorization key from the blasting machine deactivates the blasting machine, and renders the blasting machine 'safe'. However, the blasting machine is preferably configured to retain the capacity for receiving signals from the central command station when in 'safe' mode.

After removing the authorization key 23 from the blasting machine 20 the key is transferred together with the data package 25 the central command station 22, which receives the data package including the randomly generated access code. Command signals 24 (radio or otherwise) transmitted by the central command station to the blasting machine(s) may be accompanied by the data package 26. In this way, each signal is effectively directed to a specific blasting machine according to the randomly generated access code (and the unique identification code, if present). Most importantly, the selected blasting machine will only respond to the command signal(s) if at least one of the randomly generated access codes received from the central command station corresponds to the randomly generated access code originally generated and stored by the blasting machine in question.

The embodiment described above pertains to the simultaneous transmission by the central command station of the command signals and the data packages. However, the signals do not need to be transmitted in this way. Alternatively, the signals may be transmitted sequentially in any order. For example, the blasting machines may receive the command signals prior to the data packages (or vice versa) and integrate the information once all of the appropriate signals have been received.

The apparatus illustrated in FIG. 2 allows an authorized user to set up one or more blasting machines in the vicinity of the blast, and exit the blasting area carrying one or more authorization keys from the one or more of the blasting machines. The data packages are preferably only useable for a single blast event, such that a new blast event would require the reinsertion of the authorization keys into the blasting machines and the resulting generation of new randomly generated access codes. More preferably, the access codes are valid only within a predetermined time window. In this way, failure of the system operator to exit the blast area and reach the central blasting unit within the time window will result in the system being reset to a 'standby' mode, preventing subsequent actuation of the detonators. The system also permits differentiation between intact signals, and the identification of transmitted signals that have become corrupted in some way, for example, by the presence of noise in the components of the system or blasting environment.

The embodiment illustrated in FIG. 2 provides for an authorization key corresponding to each blasting machine in the system. The present invention further encompasses an alternative embodiment, in which the apparatus comprises multiple blasting machines and a single authorization key. In this way, the single authorization key may be transferred between all of the blasting machines in the system to collect and store the data packages. Once all of the required data packages have been stored on the authorization key, the single authorization key can then be conveyed to the central command station, thereby avoiding the need for multiple authorization keys. Even though the data packages are all stored on the same key, each data package will retain individual blasting machine identification information in the form of the randomly generated access codes (and the unique blasting machine identification codes, if present). In this way, the data packages once transmitted by the central command station can be adequately differentiated upon receipt by the blasting machines, even though they have been stored on a single authorization key.

Apart from generating a safer blasting environment, the use of randomly generated access codes in combination with one or more authorization keys helps in the prevention of unauthorized use of the blasting system. Preferably, if the authorization keys become lost or damaged then expiry of the access codes will prevent subsequent abuse of the system.

To further improve the security of the system, it is further preferred that the transmission of signals from the central command station to the blasting machine(s) is encrypted. For this purpose, signals originating from the central command station may be encrypted (e.g. by 32 bit encryption), and subsequently descrambled upon receipt by the blasting machine. In this way command signals and/or data packages transmitted by the central command station will be less susceptible to interception and possible abuse by an unauthorized third party, thereby further improving the overall security of the blasting system.

Figure 3:
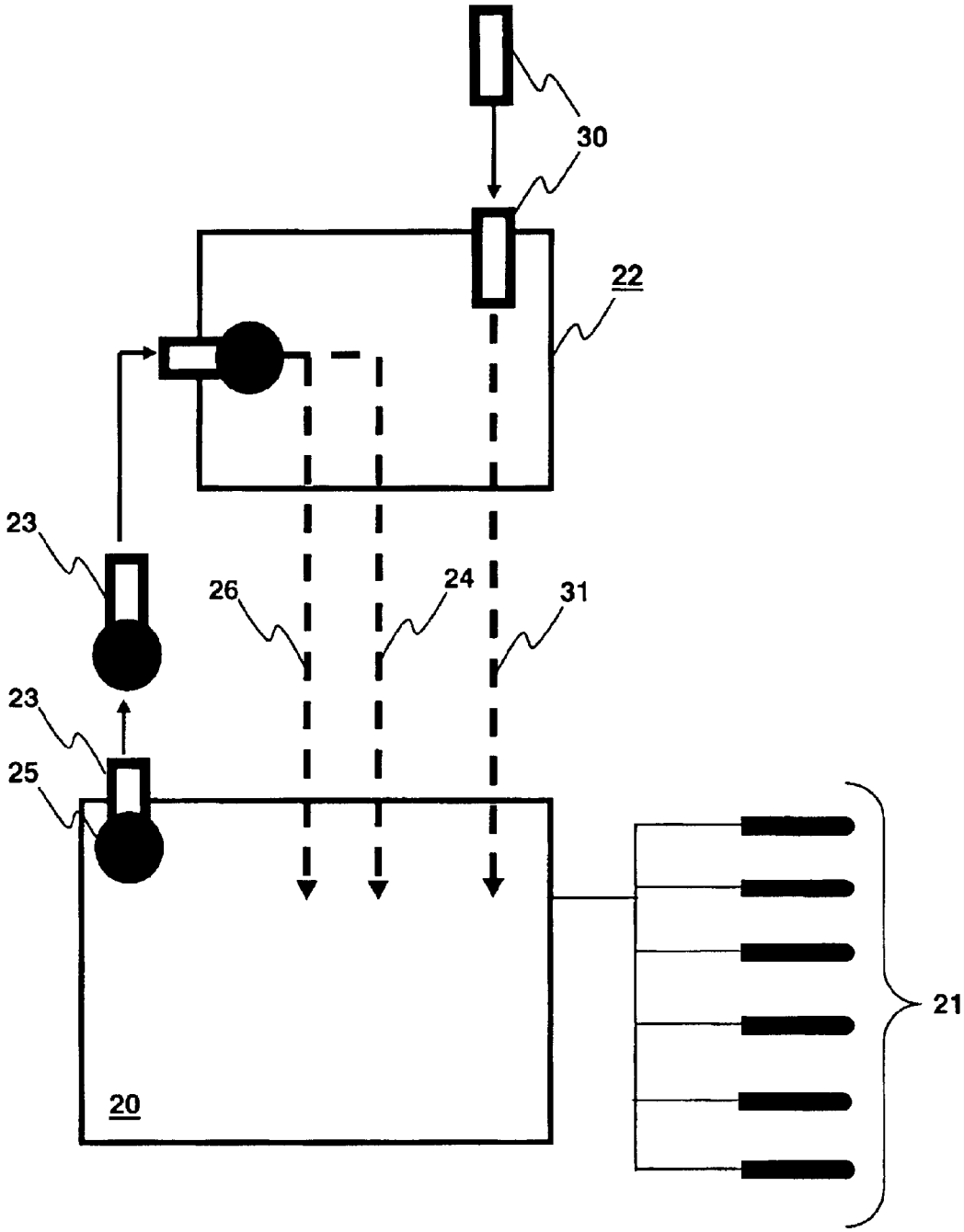
FIG. 3 schematically illustrates a preferred embodiment of the blasting system of the present invention involving a master key.

An alternative and preferred embodiment of the system of the present invention is illustrated in FIG. 3. The system is similar that the embodiment illustrated in FIG. 2 but further includes a master key 30. In a similar manner to the authorization key, the master key 30 includes a memory. However, unlike the authorization key, the master key stores a series of detonator firing codes comprising detonator identification information and/or delay times. In this way, the master key can retain all of the information necessary for detonator actuation and detonator firing sequence, thereby rendering this information independent from the main components of the blasting system. Preferably, the master key may further include authorized user identification information (e.g. a code or name etc.) that is unique to the user and specifically required for activating the blasting system.

Once the master key 30 has been inserted appropriately into the central command station, the data stored on the master key (optionally including user identification information, and detonator firing codes) is transferred to the central command station. If the user identification information is not recognized by the central command station then the central command station will not be activated to transmit information. However, if the user identification information (if present) on the master key is positively identified by the central command station, then the central command station will be activated ready to transmit information and command signals as required.

The detonator firing codes may also be transferred from the master key to the central command station, for subsequent transmission 31 to the detonators via the one or more blasting machines. Each blasting machine effectively relays the detonator firing codes from the central command station to the detonators.

The present embodiment therefore has an additional safety feature whereby this relay may only occur if the selected blasting machine is activated by the receipt of a data package from the central command station, optionally including identification information corresponding to the blasting machine, as well as a randomly generated access code corresponding to a stored access code specifically generated for the blast event. Without the data package the relay of the detonator codes and/or delay times will be blocked. The command signals and the data packages may be transmitted from the central command station to the blasting machine at any time either before, simultaneously with, or after the transmission of the detonator firing codes from the master key. The blasting machine will only relay the firing codes to the detonators when in receipt of the appropriate command signal(s) and data package (s).

Figure 4:
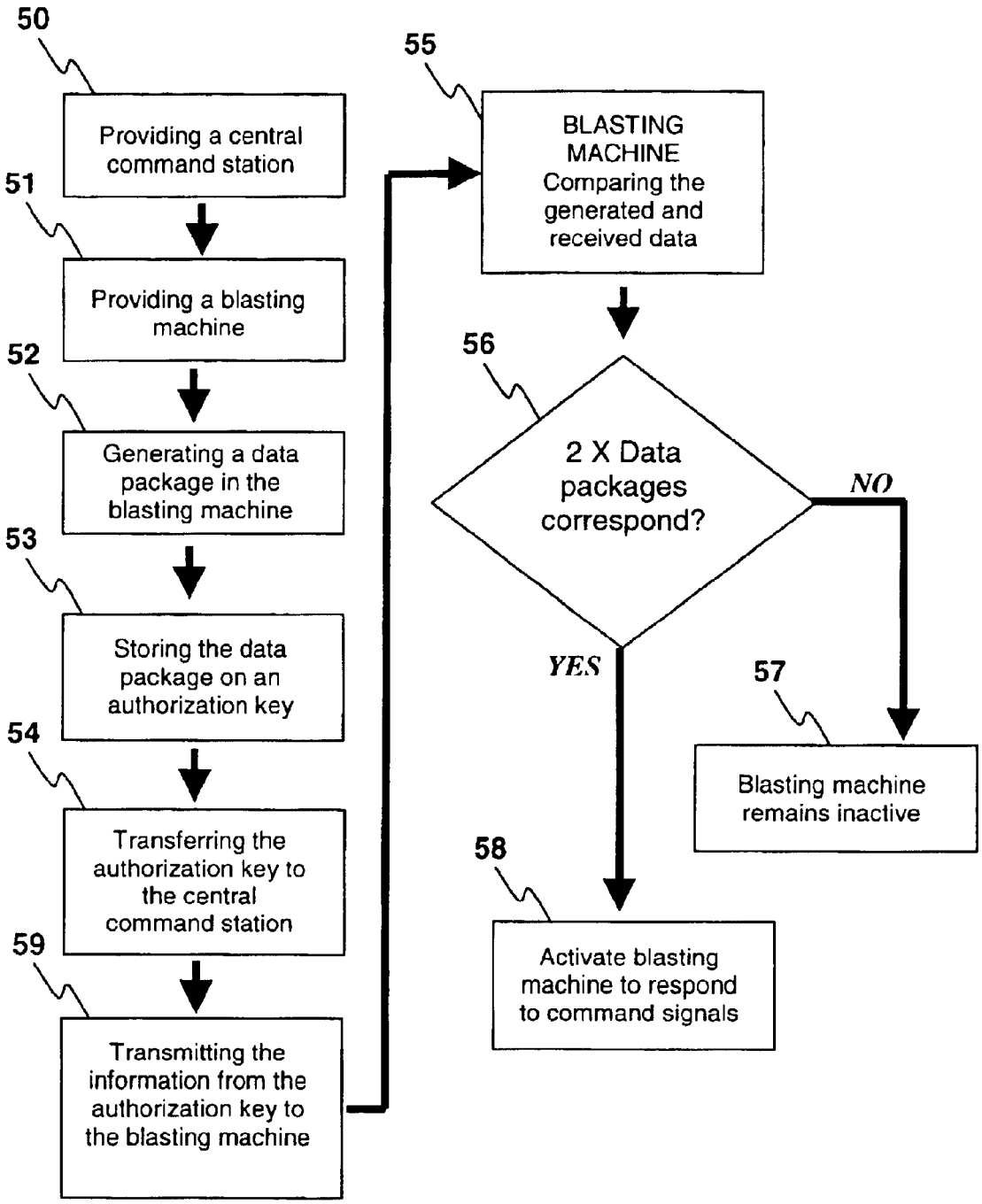
FIG. 4 provides a flow chart to illustrate the steps of a blasting method of the present invention.

The present invention further pertains to corresponding methods for the actuation of one or more detonators. In one embodiment of the invention, there is provided a method involving the steps outlined in FIG. 4. In initial steps 50 and 51 there are provided a central command station and one or more blasting machines. For ease of illustration only one blasting machine will be discussed from this point forwards. Subsequently, the blasting machine is initiated to generate a data package in step 52, wherein the data package comprises a randomly generated access code (and optionally a unique identification code for the blasting machine). At step 53, the data package is stored on an authorization key, which is transferred from the blasting machine to the central command station at step 54. Subsequently, the data package is transmitted by the central command station back to the blasting machine at step 59, where the blasting machine conducts a comparison of the generated and received data packages at steps 55 and 56. A decision is made at step 56 regarding whether the generated and received data packages correspond. If the packages do not correspond then the blasting machine is effectively remains inactive (step 57). In contrast, if the generated and received data packages do correspond at step 58, then the blasting machine is activated to respond to any command signals that accompany the data package or may be received within predetermined conditions (e.g. time limits) after or before receipt of the data package.

Figure 5:
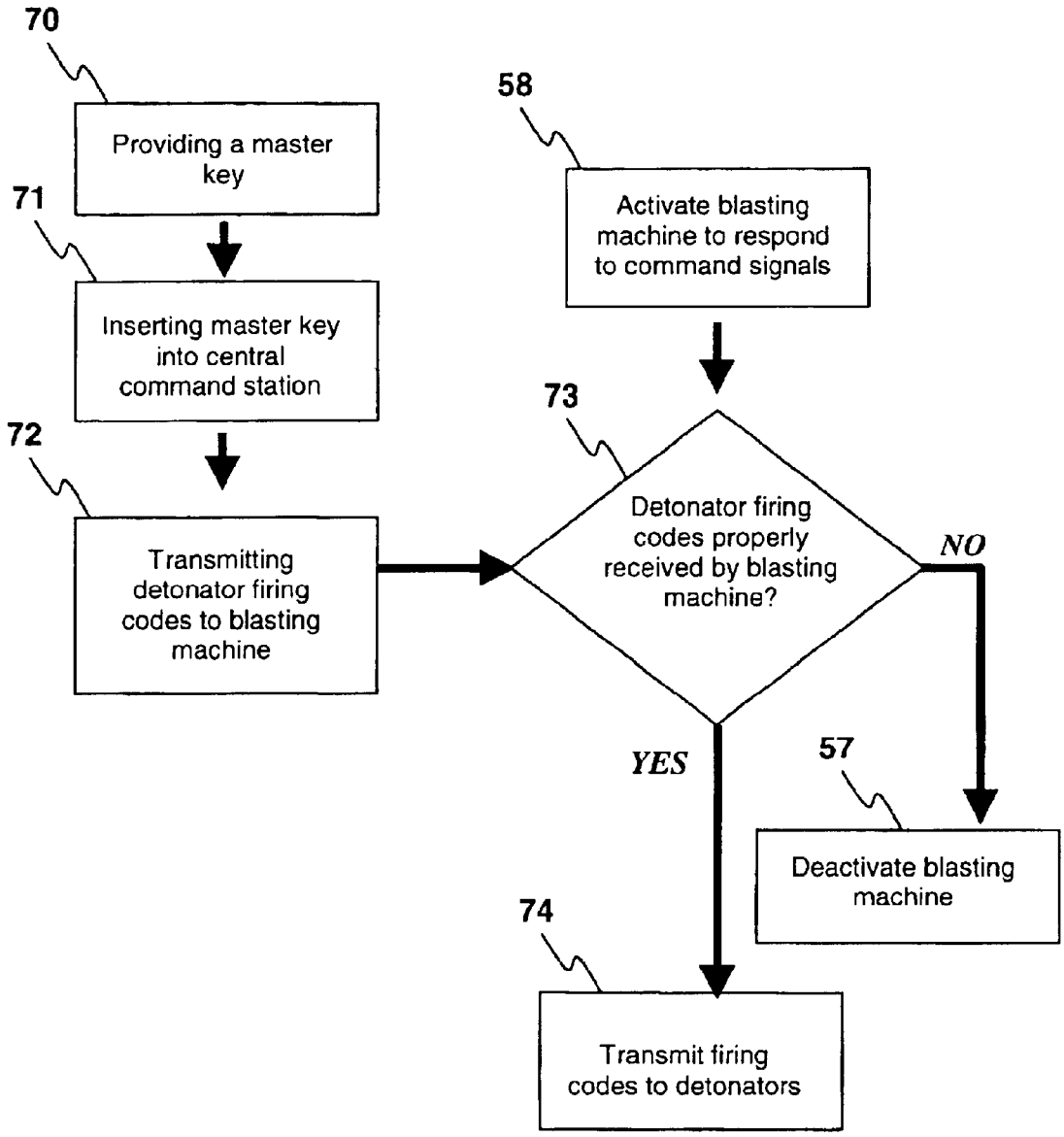
FIG. 5 provides a flow chart to illustrate the steps of a preferred blasting method of the present invention.

In a further embodiment of the present invention there is provided a preferred method involving the use of a master key, as illustrated in FIG. 5. The method illustrated includes many steps that correspond to those indicated in FIG. 4, with some notable additions. Firstly, step 70 allows for the provision of a master key, which in step 71 is inserted into the central command station. The master key comprises a memory including detonator firing codes that may optionally include detonator identification information (or detonator group identification information) and/or detonator delay times for firing. Most preferably the electronic memory of the master key may preferably further include authorized user identification information (e.g. a unique code or name specific to the authorized user) that enables positive identification of the authorized user by the central command station.

The detonator firing codes (and authorized user identification information if present) are transferred to the central command station at step 71 and subsequently transmitted (via radio signals or otherwise) to the blasting machine at step 72. At this stage, the purpose of the blasting machine is to relay the detonator firing codes to the detonators. However, this will only be possible if the blasting machine is active to process the firing codes by recognition of a suitable data package and other appropriate command signals from the blasting machine, as previously described. If the blasting machine has not received any appropriate data package or command signals from the central command station then the blasting machine will default to an inactive or 'standby' mode, and not process the detonator firing codes. Alternatively, if the blasting machine is activated by the receipt of a suitable data package and command signals, then the blasting machine will successfully relay the firing codes to the detonators for actuation thereof (step 74). Although the present embodiment has been described with reference to firing codes, the master key may alternatively store other signals/codes signals for communication with and/or control of the detonators, or groups of detonators. Such alternative signals may include, but are not limited to, arm and disarm signals.

FIG. 5 illustrates an embodiment where the firing codes are received at step 73, which occurs after the processing of the data package (and optionally other command signals). However, it is important to note that the invention encompasses further embodiments in which the blasting machine first receives and stores the firing codes, and subsequently is activated to relay the detonator firing codes to the detonators upon receipt of an appropriate data package and command signals. Therefore, the order of transmission of signals from the central command station and the order of receipt of signals by the one or more blasting machines does not generally effect the operation of the system, providing that the blasting machine is responsive to the receipt or otherwise of a corresponding generated and received data package.

The invention will now be further described with reference to the following examples, which are in no way intended to limit the scope of the invention:

EXAMPLES

Example 1

Adaptation of the I-Kontm Blasting System

The i-kon blasting system (Orica Limited) provides millisecond controlled initiation timing. The field trials of the system and methods of the present invention involved adaptation of the i-kon system, at least in part, by the integration of the Central Blasting System™ (CBS). The i-kon CBS was tested using various methods in various stages including:

Establishment of proper equipment functioning by remote control (air-to-air testing)

Establishment of contact between a central command station and a blasting machine through normal network establishment via a leaky feeder Testing of signal strengths between the system components Conducting 'dummy' firings of the i-kon CBS system The above-mentioned tests were used to refine the system, and make desirable improvements. The tests determined that modifications were required to antennae, leaky feeder lines, leaky feeder amplifiers, and radio modems to establish proper communication between system components. In addition, signal strength indicators and battery powers indicators were required on the blasting machine.

Example 2

Functional Testing of the Adapted I-Kon Cbs Blasting System

Functional field testing was conducted using a total of 26 live and 304 dummy detonators, arranged into several 'Loggers'. All 330 detonators were programmed and fired over the full system specifications (260 Ohm harness wire per logger, and 130 Ohm for the firing cables).

The following preparations were used at the blast site:

Logger#1: 22 dummy detonators

Logger#2: 25 dummy detonators

Logger#3: 15 dummy detonators

Logger#4: 18 dummy detonators

Logger#5: 25 dunmmy detonators

Logger#6: 14 live detonators with 0, 2000, 4000, 6000, 4×8000, 12000, 5×15000 ms delays Logger#7: 11 live detonators with 0, 2000, 4000, 6000, 4×8000, 12000, 2×15000 ms delays Logger#8: 200 dummy detonators After the circuits were tested for their integrity, the i-kon blasting machine was connected to the Loggers in parallel via the blasting cable.

Next, the authorization key was 'initialized' by inducing the blasting machine to transfer the serial number of the blasting machine and a unique randomly generated access code to an authorization key (also known as a Smart Dongle). The authorization key was removed from the blasting machine and transferred to the central command station (within the research and development office). The blasting machine was now in standby mode, awaiting activation by the appropriate radio signals. Antennas and a radio modem were used to transmit radio signals from the central command station. The CBS software was initiated and the radio modem switched on.

After confirming radio contact between the central command station and the blasting machine, the data from the authorization key was transferred to the central command station. In addition, a master key (master dongle) comprising the detonator firing codes and firing sequence was also associated with the central command station, and the firing information transferred appropriately.

With the central command station primed with the relevant data from the authorization key and the master key, the blasting sequence was started. All 330 detonators were programmed and initiated without errors.

During the firing sequence the blasting machine monitored some (artificial) vibrations. The vibration data were transmitted to the central blasting location to provide verification of successful firing. The blasting machine was then shut down. The CBS software automatically generated a blast report, which included the following extract (Table 1):

TABLE 1

| Logger | Serial No. | Status | Detonators | Leakage (mA) | Detonator errors |
|---|---|---|---|---|---|
| 1 | 500 | OK | 22 | 1 | 0 |
| 2 | 504 | OK | 25 | 1 | 0 |
| 3 | 502 | OK | 15 | 1 | 0 |
| 4 | 495 | OK | 18 | 1 | 0 |
| 5 | 498 | OK | 25 | 1 | 0 |
| 6 | 492 | OK | 14 | 0 | 0 |
| 7 | 506 | OK | 11 | 0 | 0 |
| 8 | 496 | OK | 200 | 1 | 0 |

While the invention has been described with reference to particular preferred embodiments thereof, it will be apparent to those skilled in the art upon a reading and understanding of the foregoing that blasting systems and methods of blasting other than the specific embodiments illustrated are attainable, which nonetheless lie within the spirit and scope of the present invention. It is intended to include all such systems and methods, and equivalents thereof within the scope of the appended claims.

What is claimed is:

1. Apparatus for controlling detonators comprising:

a central command station for transmitting at least one command signal;

at least one blasting machine in signal communication with both the central command station and a at least one group of detonators, said at least one blasting machine being able to (a) generate a data package comprising a randomly generated access code, (b) receive at least one command signal and at least one data package transmitted by the central command station, and (c) compare generated and received data packages; and at least one authorization key physically associatable with said at least one blasting machine for direct transfer to and storage of said at least one data package, and physically transferable from said at least one blasting machine to the central command station for delivery of said at least one data package to the central command station;

wherein the central command station, after receiving said at least one data package from said at least one authorization key transmits the at least one command signal and said at least one data package to said at least one blasting machine, whereupon said at least one blasting machine responds to said at least one command signal only if a data package received from the central command station is the same as the data package originally generated by said at least one blasting machine.

2. The apparatus according to claim 1, wherein said at least one data package further comprises a unique identification code corresponding to the blasting machine that generated said at least one data package.

3. The apparatus according to claim 1, wherein the central command station transmits said at least one data package and said at least one command signal to said at least one blasting machine simultaneously.

4. The apparatus according to claim 1, wherein the central command station transmits said at least one data package and said at least one command signal to the said at least one blasting a machine sequentially.

5. The apparatus according to claim 1, wherein the central command station further includes encryption means, and said at least one blasting machine further includes descrambling means, so that said at least one command signal or said at least one data package or both said at least one command sigal and said at least one data package are encrypted by the encryption means upon transmission from the central command station, and descrambled by the descrambling means upon receipt by said at least one blasting machine.

6. The apparatus according to claim 5, wherein said at least one command signal or said at least one data package or both said at least one command signal and said at least one data package are encrypted by 32 bit encryption.

7. The apparatus according to claim 1, wherein the randomly generated access code of said at least one data package is active for a single blasting event.

8. The apparatus according to claim 1, wherein the randomly generated access code of said at least one data package is active within a predetermined time window, outside of which said at least one blasting machine will not respond to said at least one command signal and said at least one data package transmitted by said central command station.

9. The apparatus according to claim 1, wherein the central command station is located remote from said at least one blasting machine and said detonators.

10. The apparatus according to claim 9, wherein said at least one blasting machine and the central command station are in radio-signal communication.

11. The apparatus according to claim 1, wherein said at least one group of detonators is in signal communication with said at least one blasting machine via low energy detonation cord, shock tube, or electrical connection.

12. The apparatus according to claim 1, wherein said at least one authorization key comprises a single authorization key transferable between said at least one blasting machine for storing said at least one data package.

13. The apparatus according to claim 1, wherein said at least one command signal is selected from the group consisting of ARM, FIRE, and DISARM signals.

14. The apparatus according to claim 13, wherein each FIRE signal is specific for each detonator or each group of detonators, each FIRE signal including a delay component to specify a firing delay for each detonator or each group of detonators thereby determining a firing sequence for the detonators.

15. The apparatus according to claim 1, further comprising:

a master key including a memory for storing detonator firing codes;

wherein said detonators include built-in firing codes, and association of said master key with said central command station permits transfer of stored detonator firing codes to said central command station for transmission to said at least one blasting machine, said at least one blasting machine being able to relay said detonator firing codes to said detonators, said at least one blasting machine relaying said detonator firing codes and said at least one command signal only if a data package received from the central command station is the same as the data package originally generated by said at least one blasting machine, said detonators firing only if said detonator firing codes relayed from an associated blasting machine are the same as said built-in firing codes for said detonators.

16. A method of controlling of detonators, the method comprising the steps of:

(a) providing a central command station for transmitting at least one command signal;

(b) providing at least one blasting machine in signal communication with at least one group of detonators and the central command station, said at least one blasting machine being able to (i) generate a data package comprising a randomly generated access code, (ii) receive at least one command signal and at least one data package transmitted by the central command station, and (iii) compare generated and received data packages;

(c) generating a data package in each blasting machine, comprising a randomly generated access code;

(d) providing at least one authorization key physically associatable with said at least one blasting machine for direct transfer to and storage of said at least one data package, and physically transferable from said at least one blasting machine to the central command station for delivery of said at least one data package to the central command station;

(e) transferring said at least one authorization key from said at least one blasting machine to said central command station;

(f) inputting said at least one data package from said at least one authorization key to said central command station; and (g) transmitting said at least one command signal together with said at least one data package from said central command station to said at least one blasting machine, said at least one blasting machine responding to said at least one command signal only if a data package received from the central command station is the same as the data package originally generated by said at least one blasting machine.

17. The method according to claim 16, wherein said at least one data package further comprises a unique identification code corresponding to the blasting machine that generated said at least one data package.

18. The method according to claim 16, wherein in step (g) the central command station transmits said at least one data package and said at least one command signal to said at least one blasting machine simultaneously.

19. The method according to claim 16, wherein in step (g) the central command station transmits said at least one data package and said at least one command signal to said at least one blasting machine sequentially.

20. The method according to claim 16, wherein in step (g) said at least one command signal or said at least one data package, or both said at least one command signal and said at least one data package are encrypted upon transmission by the central command station, and descrambled upon receipt by said at least one blasting machine.

21. The method according to claim 20, wherein in step (g) said at least one command signal or said at least one data package, or both said at least one command signal and said at least one data package are encrypted by 32 bit encryption.

22. The method according to claim 16, wherein the randomly generated access code of said at least one data package is active for a single blasting event.

23. The method according to claim 16, wherein the randomly generated access code of said at least one data package is active within a predetermined time window, outside of which said at least one blasting machine will not respond to said at least one command signal and said at least one data package transmitted by said central command station.

24. The method according to claim 16, wherein the central command station is located remote from said at least one blasting machine and said detonators.

25. The method according to claim 24, wherein said at least one blasting machine and the central command station are in radio-signal communication.

26. The method according to claim 16, wherein said at least one group of detonators is in signal communication with said at least one blasting machine via low energy detonation cord, shock tube, or electrical connection.

27. The method according to claim 16, wherein said at least one authorization key comprises a single authorization key transferable between said at least one blasting machine and the central command station for storing said at least one data package.

28. The method according to claim 16, wherein in step (g) said at least one command signal is selected from ARM, FIRE, and DISARM signals.

29. The method according to claim 28, wherein in step (g) each FIRE signal is specific for each detonator or each group of detonators, each FIRE signal including a delay component to specify a firing delay for each detonator or each group of detonators thereby determining a firing sequence for the detonators.

30. A method of controlling initiation of detonators having built-in firing codes the method comprising the steps of:

(a) providing a central command station for transmitting at least one command signal;

(b) providing at least one blasting machine in signal communication both with a at least one group of detonators and the central command station, said at least one blasting machine being able to (i) generate a data package comprising a randomly generated access code, (ii) receive at least one command signal and at least one data package transmitted by the central command station, and (iii) compare generated and received data packages;

(c) generating a at least one data package in said at least one blasting machine, said at least one data package comprising a randomly generated access code;

(d) providing at least one authorization key physically associatable with said at least one blasting machine for direct transfer to and storage of said at least one data package, and physically transferable from said at least one blasting machine to the central command station for delivery of said at least one data package to the central command station;

(e) transferring said at least one authorization key from said at least one blasting machine to said central command station;

(f) inputting said at least one data package from said at least one authorization key to said central command station;

(g) providing a master key including a memory for storing detonator firing codes;

(h) transferring the detonator firing codes from the master key to the central command station; and (i) transmitting said at least one command signal, the detonator firing codes, and said one at least one data package from said central command station to said at least one blasting machine, said at least one blasting machine relaying said detonator firing codes and said at least one command signal to said detonators only if a data package received from the central command station is the same as the data package originally generated by said at least one blasting machine, the detonators firing only if said detonator firing codes relayed from said at least one blasting machine is are the same as said built-in firing codes for said detonators.

31. The method according to claim 30, wherein said at least one data package further comprises a unique identification code corresponding to the blasting machine that generated said at least one data package.

32. The method according to claim 30, wherein in step (i) the central command station transmits the detonator firing codes, said at least one data package and said at least one command signal to said at least one blasting machine simultaneously.

33. The method according to claim 30, wherein in step (i) the central command station transmits the detonator firing codes, said at least one data package and said at least one command signal to said at least one blasting machine sequentially.

34. The method according to claim 30, wherein the master key further stores user identification information for recognition by said central command station.

35. The method according to claim 30, wherein the detonator firing codes comprise detonator identification codes or detonator delay times, or both detonator identification codes and detonator delay times.

* * * * *

UNITED STATES PATENT AND TRADEMARK OFFICE

CERTIFICATE OF CORRECTION

PATENT NO. : 6,851,369 B2
DATED : February 8, 2005
INVENTOR(S) : Hummel et al.

It is certified that error appears in the above-identified patent and that said Letters Patent is hereby corrected as shown below:

Column 14,
Line 33, after "and", delete "a".

Column 17,
Line 39, after "generating", delete "a".

Signed and Sealed this

Twelfth Day of July, 2005

JON W. DUDAS
*Director of the United States Patent and Trademark Office*